US005193474A

United States Patent [19]

Urai et al.

[11] Patent Number: 5,193,474

[45] Date of Patent: Mar. 16, 1993

[54] METHOD OF FEEDING A UNITARY SHEET OF TRIM COVER ASSEMBLY TO MULTIPLE-NEEDLE SEWING MACHINE FOR CREATING PLURAL STITCHES THEREON

[75] Inventors: Muneharu Urai; Kazuo Katsuta; Minoru Hosoya; Tadafumi Abe; Ryosuke Wada, all of Akishima, Japan

[73] Assignee: Tachi-S Co., Ltd., Akishima, Japan

[21] Appl. No.: 838,367

[22] Filed: Feb. 19, 1992

[30] Foreign Application Priority Data

Feb. 21, 1991 [JP] Japan ..... 3-049052

[51] Int. Cl.[5] ..... D05B 27/00; D05B 39/00

[52] U.S. Cl. ..... 112/262.3; 112/121.23; 112/163

[58] Field of Search ..... 112/262.1, 262.3, 121.23, 112/163, 164, 165, 166, 167, 144; 223/28, 30, 31, 34, 35

[56] References Cited

U.S. PATENT DOCUMENTS 3,802,361 4/1974 Block ..... 112/144 X
4,125,079 11/1978 Black ..... 112/121.23 X
4,928,609 5/1990 Kawasaki ..... 112/121.23 X

FOREIGN PATENT DOCUMENTS 3304343 6/1984 Fed. Rep. of Germany ..... 112/163

*Primary Examiner*—Peter Nerbun
*Attorney, Agent, or Firm*—Oldham Oldham & Wilson Co.

[57] ABSTRACT

A method of feeding a unitary sheet of trim cover assembly to a multiple-needle sewing machine for creating plural stitches thereon, in which non-parallel stitches are formed among parallel stitches on the trim cover assembly by means of a guide member having a sloped portion. The sloped configuration of the guide member causes formation of sloped, folded portion in the trim cover assembly, and the trim cover assembly with such folded portion is fed to the multiple-needle sewing machine.

11 Claims, 9 Drawing Sheets

METHOD OF FEEDING A UNITARY SHEET OF TRIM COVER ASSEMBLY TO MULTIPLE-NEEDLE SEWING MACHINE FOR CREATING PLURAL STITCHES THEREON

BACKGROUND OF INVENTION

1. Field of Invention

The present invention relates to a method of feeding one unitary sheet of a trim cover assembly used on an automotive seat to a multiple-needle sewing machine for the purpose of forming plural decorative stitches on the trim cover assembly.

2. Description of Prior Art

In fabrication of an automotive trim cover assembly, there has been practiced a multiple stitching process which uses a multiple-needle sewing machine (or a multi-axis sewing machine) having a plurality of sewing needles mounted thereon, so as to form plural decorative stitched seams upon the trim cover assembly at one time.

FIGS. 1A and 1B shows an example of conventional multiple stitching method, in which it is seen that a trim cover assembly (1) is fed to a multiple-needle sewing machine (M) and then formed with a plurality of stitched seams (41, 42, . . . ) extending linearly in parallel with one another. (See the Japanese Laid-Open Patent Pub. No. 64-34394, for instance).

Briefly stated, the trim cover assembly (1) comprises a typical three-layer lamination of a top surface layer (111), a wadding layer (112) of urethane foam slab material and a wadding cover (113), and the sewing machine (M) is provided with a plurality of needles (M1, M2, . . . M10). As shown in FIG. 1B, the decorative seams (41, 42, . . . ) are formed in the trim cover assembly (1) in a parallel spaced-apart relation with one another, by means of those needles.

This parallel rectiliner multiple sewing, however, is defective in having difficulty in effecting a slant sewing for forming an obliquely stitched point on the cover member, as may be required from a design demand, in which case, it is necessary to prepare a separate slant section of the trim cover assembly and sew the same to the main body of the trim cover assembly.

Further, the present sewing method is not applicable to such new mode of rear seat as shown in FIG. 2(D), which has a protruded portion (H) formed centrally thereof. As illustrated, the protruded portion (H) varies in height from the forward side to the rearward side; namely, its height increases as it proceeds from the forward side of seat to the rearward side of same. The trim cover assembly covering this kind of seat requires a proper design and stitching in its seating surface section in order to give parallel stitched seams thereon. Thus, in this case, can the above-mentioned sewing method be directly applied, and separate stitched sections must be sewn together to form a required portion of trim cover assembly that covers the protruded portion (H) in question.

This problem is of a particular concern, and will be described more concretely with reference to FIGS. 2(A) to 2(E). As understandable from FIGS. 2(A), 2(C) and 2(D), the seat cushion (SC) of a rear seat is composed of a urethane foam molded cushion body (2), with the trim cover assembly (1) fixed thereover by means of the stitch sewing. FIGS. 2(A) and 2(C) show in cross-section the forward and rearward sides of seat cushion (SC), respectively along the lines A—A and C—C in FIG. 2(D), thus depicting a small height of the protruded portion (H) at the rearward side as in FIG. 2(A) and a greater height of same at the forward side as in FIG. 2(C). With such seat cushion structure, a technical concern is directed to how the stitches or stitched seams are to be formed neatly in parallel, while conforming to the uneven shape of the protruded portion (H). This can be achieved from the stitching pattern represented in FIG. 2(E), which schematically shows an exploded state of the trim cover assembly (1). As shown, excepting the central set of stitches (41, 41), the remaining stitches (42, 43) must be drawn by a separate sewing step which involves orienting the trim cover assembly (1) at a required angle. It follows thus that, during the sewing upon the cushion body (2), the unitary sheet of trim cover assembly (1) should be subject to a parallel stitching for forming the pair of central stitches (41, 14) and also to a non-parallel stitching for forming, relative thereto, a plurality of slant stitches (42, in a symmetrical fashion.

Consequently, this factor is practically an obstacle against the availability of the above-mentioned automatic plural stitching method using a multiple-needle sewing machine.

SUMMARY OF THE INVENTION

In view of the above shortcomings, it is thus a purpose of the present invention to provide a method of feeding a unitary sheet of trim cover assembly to a multiple-needle sewing machine, which permits formation of non-parallel or slant stitched seams in addition to parallel stitched seams by use of the ordinary multiple-needle sewing machine.

To achieve this purpose, according to the present invention, there is basically provided the steps of pinching upwardly a part of the trim cover assembly such as to form a folded portion therein; causing said folded portion to be inclined at a certain inclination angle, thereby making its upper edge sloped at that inclination angle; retaining the folded portion upon a guide means; then feeding thus-formed trim cover assembly with the sloped, folded portion defined therein towards the multiple-needle sewing machine; and creating plural stitches on the trim cover assembly by means of the sewing machine, allowing the plural stitches to be formed on the opposite sides of the folded portion in a parallel relation with one another, whereby an expanded sheet of the trim cover assembly, after having undergone the stitching, contains some of said trim cover assembly stitches in parallel with one another, whereas other of the stitches extend in a non-parallel manner relative to such some of the plural stitches.

Thus, when thus-stitched trim cover assembly is affixed over a seat having a protrudent portion which is inclined at an angle equal to the above-stated inclination angle, then the pinched or folded portion of trim cover assembly is located on the protrudent portion, and the non-parallel or slant stitches is caused to lie in parallel with the protrudent portion and the stitches which are parallel thereto.

In one aspect of the invention, it is desirable to form the trim cover assembly, prior to being stitched by the sewing machine, in such a fashion that, relative to its rectangular body, an inclined section is defined, which has an inclination angle substantially equal to the inclination angle of the folded portion (that means the inclination angle of the protrudent portion of seat). In this way, when pinching such trim cover assembly at the inclined section to form a folded portion in accordance with the inclination angle, the trim cover assembly assumes generally a rectangular shape on the whole, presenting a uniform flat surface without creases therein. This is advantageous in expediting the stitching process with no trouble and obtaining precisely and neatly stitched patterns on the trim cover assembly.

Preferably, the foregoing guide means may comprise a movable guide member slidable on the table of the sewing machine or a stationary guide member fixed on that table, both of which guide members are sloped at their respective upper edges at an angle equal to the above-mentioned inclination angle. In case of the movable guide member, the trim cover assembly is fed to the sewing machine along with the guide member, and in case of the stationary guide member, the trim cover assembly is passed through the guide member towards the sewing machine. A cap-like securing member may be used in cooperation with any of those guide members to positively secure the trim cover assembly on the guide member. To closely settle trim cover assembly along the guide member, some weight plates may be placed on the trim cover assembly adjacent to the guide member. Alternatively, a combination of sprocket and needle endless chain or a combination of a roller and corrugated guide members may be applied in order to aid in feeding the trim cover assembly towards the sewing machine.

DETAILED DESCRIPTION OF PREFERRED EMBODIMENTS OF THE INVENTION

Hereinafter, a specific description will be made with reference to a method of feeding a unitary sheet of a trim cover assembly to a multiple-needle sewing machine in accordance with present invention. It should be noted that the present invention concerns an improvement on the basis of the previously stated conventional elements and sewing machines, i.e. a seat cushion (SC) having a protrudent portion (H), a three-layer trim cover assembly (1) and multiple-needle sewing machine (M) with a work table (7) on which the trim cover assembly (1) is fed into or from the needle area of sewing machine. Hence, all like designations in the prior art description correspond to like ones in this description.

Figure 2:
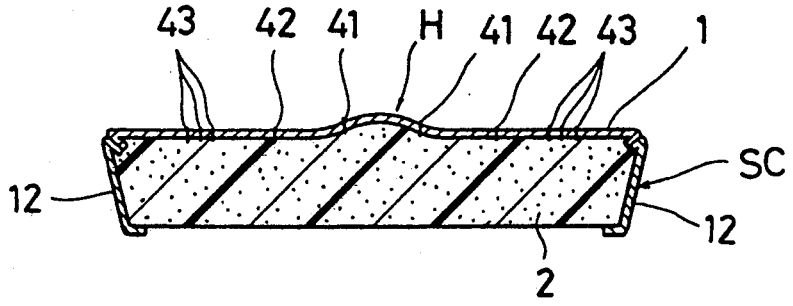
FIG. 2(A) is a sectional view taken along the line A—A in FIG. 2(D)
FIG. 2(B) is a plan view of a seat cushion as in FIG. 2(D)
FIG. 2(C) is a sectional view taken along the line C—C in FIG. 2(D)
FIG. 2(D) is a perspective view of a seat cushion covered with the trim cover assembly.
FIG. 2(E) is an exploded plan view of the trim cover assembly, showing its expanded state.
FIG. 2(F) is a view to explain one aspect of method in the present invention.
Figure 2:
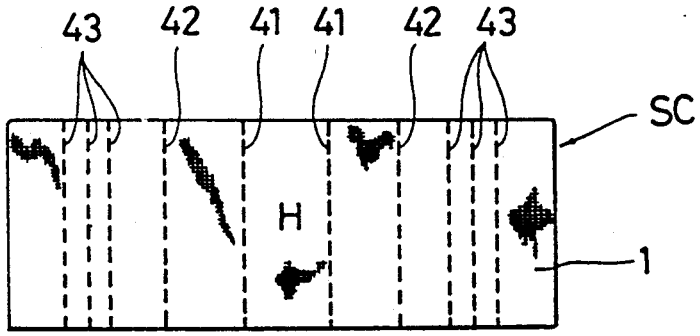
Figure 2:
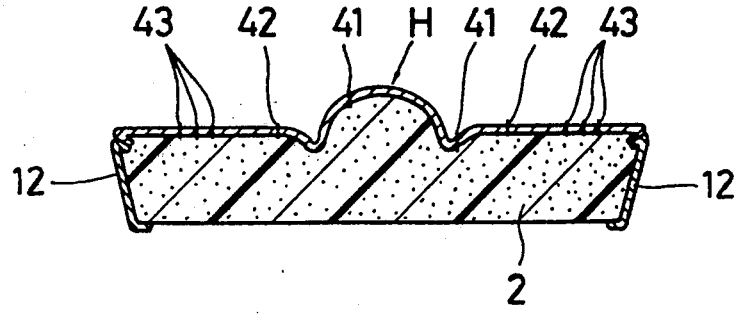
Figure 2:
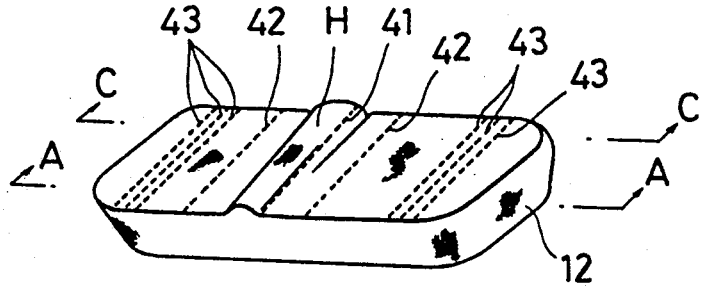
Figure 2:
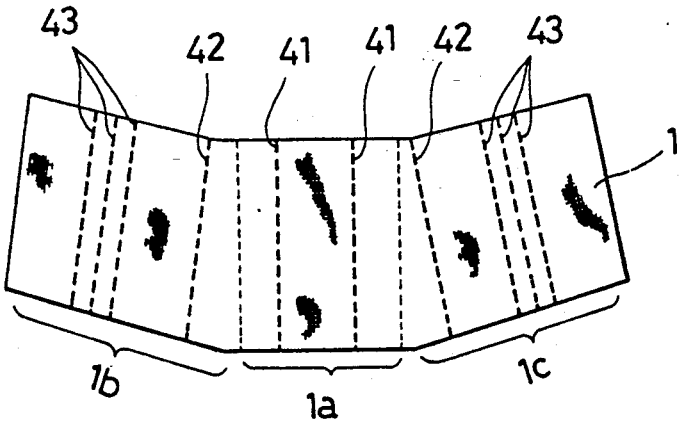
Figure 2:
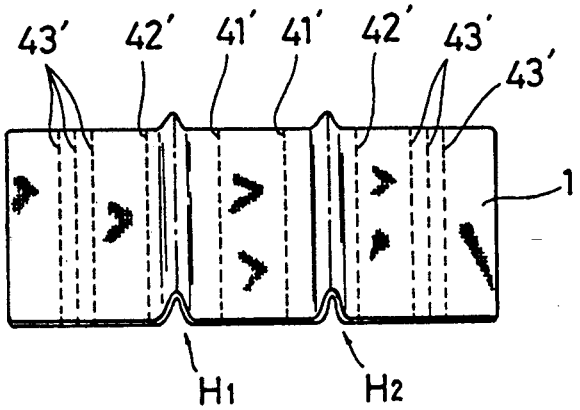
Figure 3:
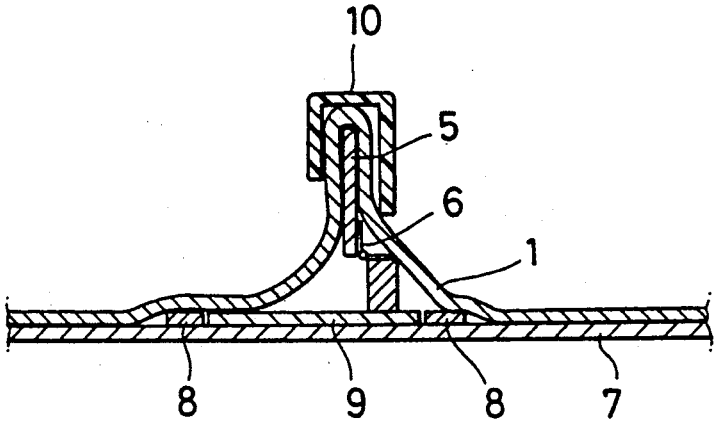
FIG. 3(A) is a sectional view of a first embodiment of feeding device used in the present invention, showing the state where a hinged guide member is set in an upright position.
FIG. 3(B) is a sectional view of the same first embodiment, showing the state where a hinged guide member is set in a horizontal position.
Figure 3:
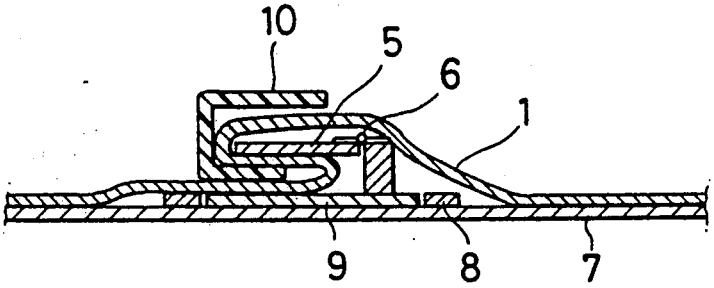

Referring firstly to FIGS. 2(A) to 2(E), let us describe a concept of allowing the trim cover assembly (1) to be formed with a combination of parallel stitched seams (41) and non-parallel or slant stitched seams (42, 43), by use of the ordinary multiple-needle sewing machine (M). In order to produce the seat cushion (SC) having such mixed parallel and non-parallel stitch patterns, it is essential to initially prepare such trim cover assembly as shown at the exploded state in FIG. 2(E). Although this FIG. 2(E) illustrates a resultant trim cover assembly (1) that has been sewn by the sewing machine (M), yet let it be assumed that the same trim cover assembly (1) without those stitch patterns (41, 42, 43) is prepared, which implies the cover element (1) to be in the state prior to sewing by the machine (M). Hence, as can be seen in FIG. 2(E), the trim cover assembly (1) is profiled slightly in U shape on the plane, such that both right- and left-side sections (1*b*)(1*c*) are inclined upwardly relative to the respective vertical lines of boundaries defined at both sides of central section (1*a*), at the same inclination angle.

It is important to note that the inclination angle of those two side sections (1*b*)(1*c*) correspond to that of slant stitched seams (42, 43). This is because, as set forth later, the inclination angle of the slant stitched seams (42)(43) relative to the central pair of parallel stitched seams (41) which lies in parallel with the protruded portion (H), must be naturally equal to the inclination angle of protruded portion (H) that has been discussed in the prior art description.

Now, looking at FIG. 2(F), it is seen that the two areas as indicated by the one-dot chain lines (H1)(H2), in the trim cover assembly (1), may be pinched upwardly such as to simultaneously displace its both lateral sections (1*b*)(1*c*) towards its central section (1*a*), so that the whole shape of trim cover assembly (1) is transformed into the rectangular shape. In that way, as in FIG. 2(F), the imaginary stitch lines (41', 42', 43') are all disposed in a parallel relation with one another. The imaginary stitch lines (41', 42', 43') are hereby defined to imply sewing traces to be drawn by the needles (M1, M2 . . . M10) of sewing machine (M) upon the trim cover assembly (1) and also imply the resultant stitched seams (41, 42, 43).

Therefore, the rectangular state of trim cover assembly (1) thus created, as shown in FIG. 2(F), effectively permits direct use of the multiple-needle sewing machine (M) for stitching the trim cover assembly (1).

This novel sewing method will be clarified by way of several embodiments shown in FIGS. 3 through 12.

Referring now to FIGS. 3 through 7, there is illustrated a first embodiment of the present invention. In these figures, only one feeding device (A) is shown, but it should be noted that the same feeding device is provided in a spaced-apart and parallel relation with that former one, thus, there are provided a pair of feeding devices (A) in this particular embodiment. Each of the two feeding devices (A) should be formed in a size smaller than the width defined by the two imaginary stitch lines (41')(42') as understandable from FIGS. 5 and 6. Further, they are each arranged at a position corresponding to the respective areas defined between the stitched seams (41)(42).

Description will, for the simplicity sake, be made only of the left-side one of the two feeding devices (A). According to the present first embodiment, fixed on the work table (7) of multiple-needle sewing machine (M), is a pair of guide rails (8) both extending in parallel with each other along the sewing direction of machine (M) as indicated by the arrow in FIG. 5. Though not shown, one end of the guide rails (8) terminates adjacent to the needle area of sewing machine (M). A movable guide member (9) is slidably fitted between those two guide rails. The movable guide member (9) is made of a plate-like material, having an upper hinged guide section (5) erected from the guide member (9). The upper hinged guide section (5) comprises two separate upper and lower parts, both of which are connected together by a hinge (6) such that the upper part is rotatable on and relative to the lower one that is fixed on the movable guide member (9). In the embodiment shown, the upper part of hinged guide section (5) can be turned outwardly of the guide member (9) down to a substantially horizontal line (see FIG. 3(B)), representing approx. 90-degree rotation range from the upright position (as in FIG. 3(A)) to that horizontal securing position.

Figure 4:
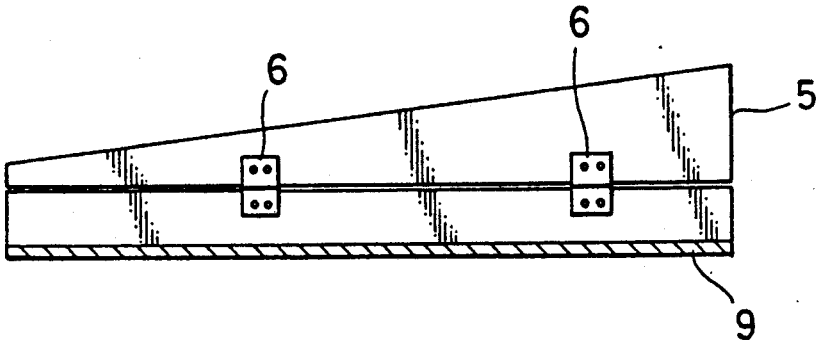
FIG. 4 is an elevational side view of the hinged guide member.
Figure 5:
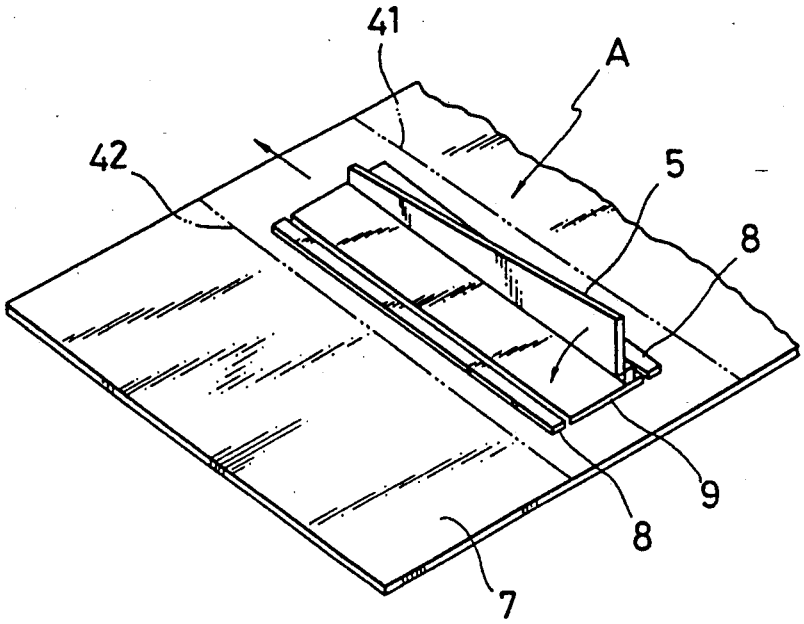
FIG. 5 is a partly broken perspective view of a table of the sewing machine, showing the hinged guide member to be mounted on the table.

In FIG. 4, the hinged guide section (5) is depicted as being formed straight lengthwise, such that its height increases from the left-side end to the right-side end, defining a sloped upper edge. In this context, the relatively lower left side end is to be situated near the needle area of sewing machine (M).

It is important that the inclination angle of such sloped upper edge in the guide section (5) be in conformity with that of the afore-stated protruded portion (H) of seat cushion (SC).

In operation, as a first step, referring to FIG. 3(A), the guide section (5) is set in an upright state, and then one unitary sheet of trim cover assembly (1) is placed upon the top end of that guide section (5) and part-way squeezed there slightly, while laying the remainder over the movable guide member (8) and table (7). Thereafter, a cap-like securing member (10) is fitted over the top end of guide section (5) so that the trim cover assembly (1) is firmly secured at the guide section (5).

Figure 6:
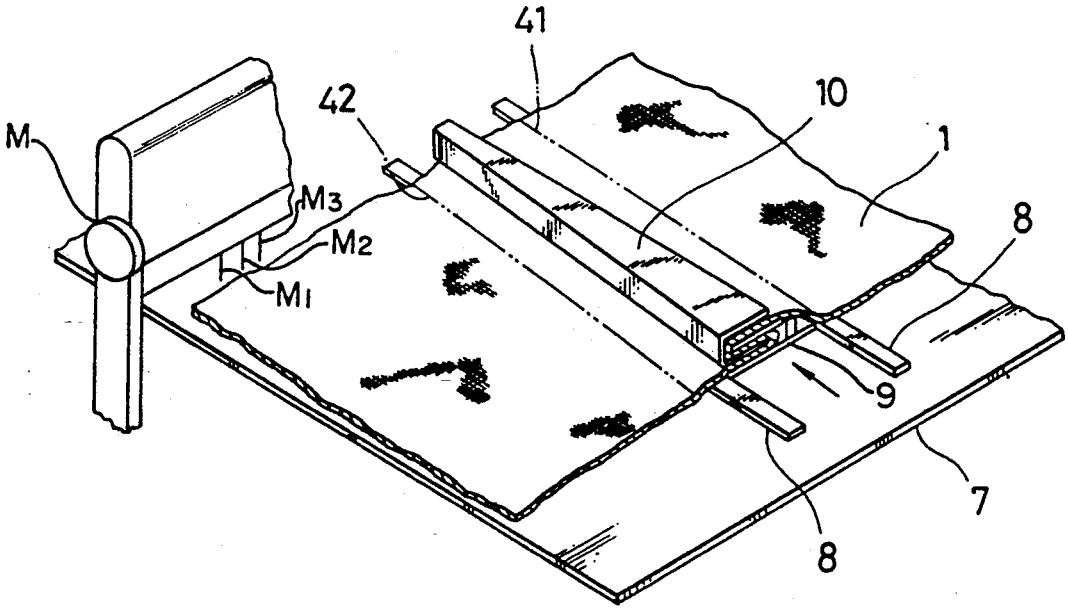
FIG. 6 is a partly broken perspective view showing the trim cover assembly to secured on the hinged guide member.

The securing member (10) is formed from a material of generally channel shape in section, and in a shape conforming to that of guide section (5), as can be seen from FIG. 6. Thus, the lower edges of securing member (10) are sloped at the same inclination angle with the upper edge of guide section (6).

Then, as shown in FIGS. 3(B) and 6, the hinged upper part of guide section (5) is turned down together with the relevant part of trim cover assembly (1), from the upright setting position to the horizontal securing position. The securing effect is thus enhanced, because the trim cover assembly (1) is folded in a positive way by thus-turned guide section in addition to the securing member (10). Further, the height of trim cover assembly (1) at this area is lowered as compared with that in the erected state in FIG. 3(A). This advantageously allows for avoiding the interference of the hinged guide section (5) with the sewing needles of machine (M).

It is thus to be understood that both guide sections of two feeding devices (A) are turned outwardly away from each other in relation to the spacing therebetween and then respectively laid on the position shown in FIG. 3(B).

Under this state, the movable guide member (9) is translated along the guide rails (8) in the direction as shown in FIG. 6, so that the trim cover assembly secured thereby is fed towards the needle area of multiple-needle sewing machine (M). As viewed in FIG. 6, upon the sewing machine (M) being operated, the left-side end portion of trim cover assembly (1) is subjected to multi-needle stitching, and then, by virtue of feeding force created by the vertical reciprocations of plural needles (M1 . . . M10), the cover member (1) continues to be fed to the sewing machine (M) for the stitching purpose.

At the completion of stitching, the resulting trim cover assembly (1) is removed from the foregoing feeding devices (A). As a result, the expanded trim cover assembly (1) assumes such stitched pattern representation as in FIG. 2(E) in which a pair of parallel stitched seams (41)(41) run vertically across the trim cover assembly (1), while a pair of non-parallel or slant stitched seams (42)(42) and three pairs of likewise slant stitched seams extend on the opposite sides of and symmetrically relative to that central paired parallel stitched seams (41) (41).

Thus-finished trim cover assembly (1) is then stretched over and secured upon the outer surfaces of cushion body (2), by locating and placing the center of trim cover assembly (1) on the protruded portion (H).

Accordingly, it is appreciated that, as the central area, between (41) and (41), of trim cover assembly (1) lies along the sloped contour of protruded portion (H), both side sections (1*b*)(1*c*) of trim cover assembly (1) are caused to move toward each other by the above-stated inclination angle of protruded portion (H); in other words, both side sections (1*b*)(1*c*) are displaced towards the protruded portion by such angle, to thereby offset the corresponding inclination angles of slant stitched seams (42)(43). As the consequence thereof, all those non-parallel stitches (42)(43) are rowed in parallel with the central parallel stitches (41), whereupon as shown in FIG. 2(B), all the decorative stitches are represented neatly in parallel relation with one another, irrespective of the protruded portion (H).

Figure 7:
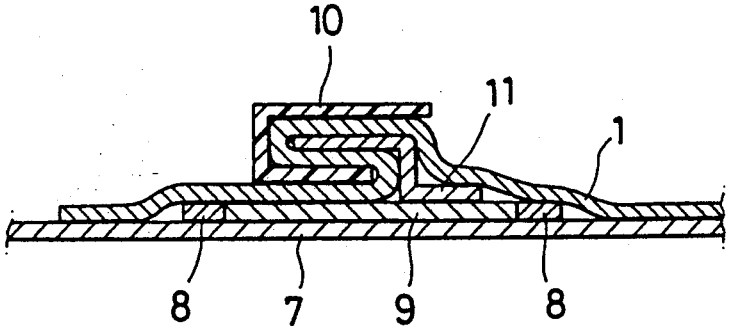
FIG. 7 is a sectional view showing a second mode of guide member in association with the first embodiment.
Figure 8:
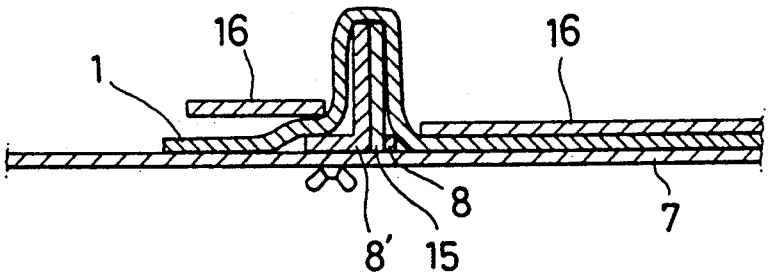
FIG. 8(A) is a sectional view of a third embodiment of feeding device.
FIG. 8(B) is an elevational view of the feeding device as in FIG. 8(A)
Figure 8:
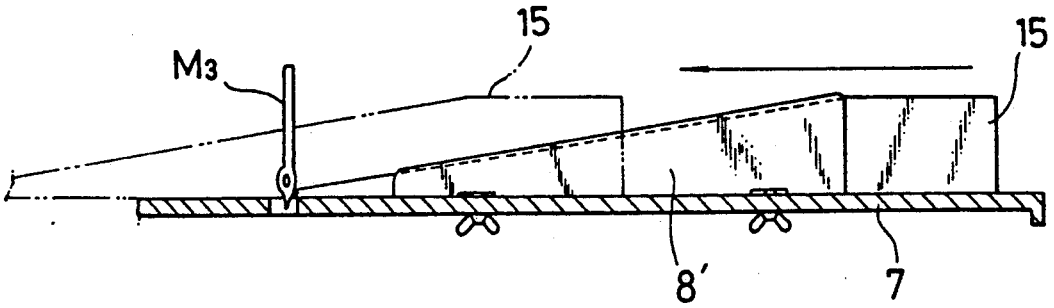
Figure 9:
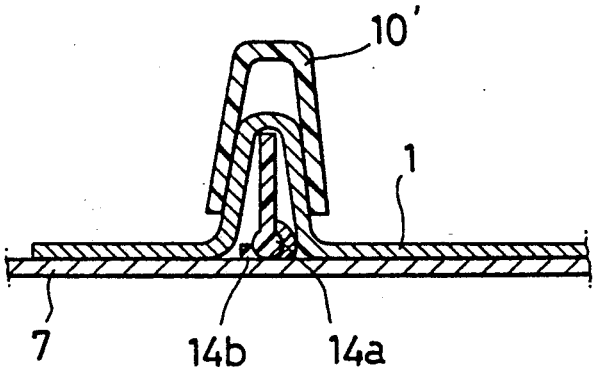
FIG. 9(A) is a sectional view of a fourth embodiment, showing the state of the trim cover assembly being secured to a guide member by a securing member.
FIG. 9(B) is a sectional view showing the guide member to be set in a horizontal position.
FIG. 9(C) is a sectional view showing the state where the folded portion of trim cover assembly is provisionally retained after having removed a part of the guide member.
Figure 9:
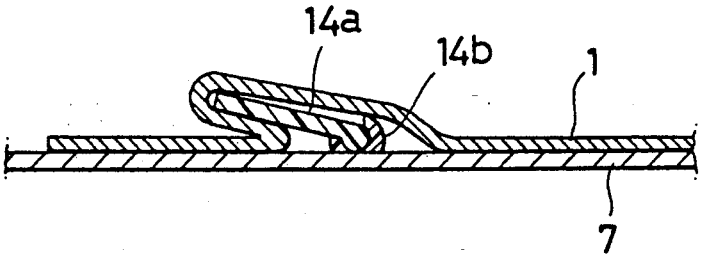
Figure 9:
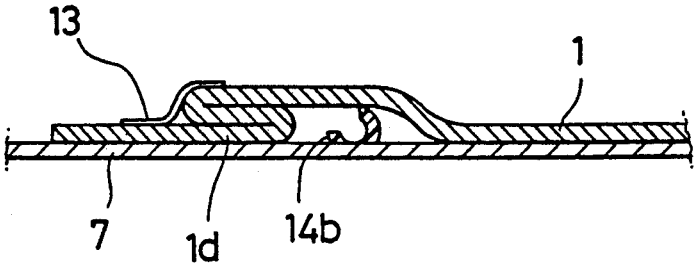
Figure 10:
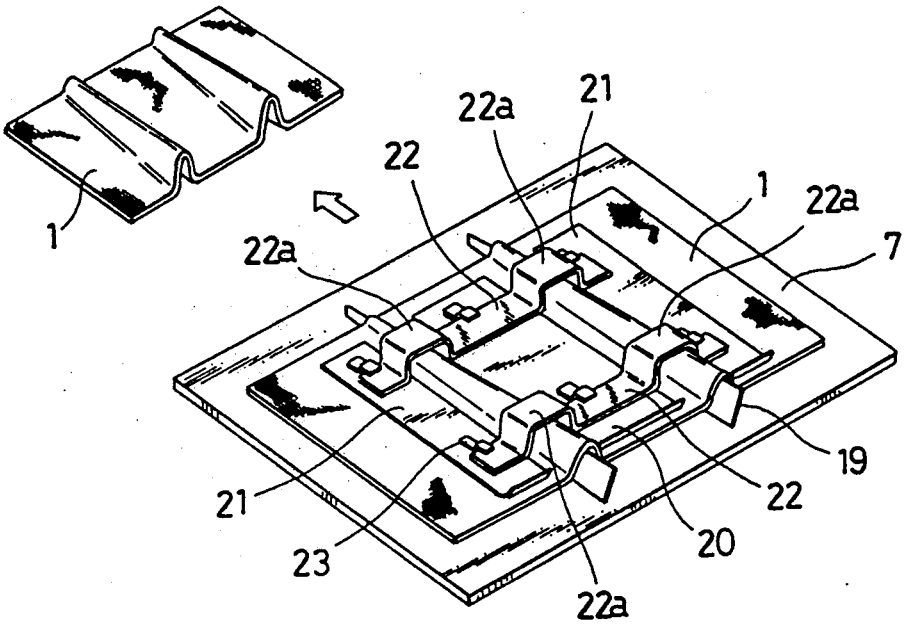
FIG. 10(A) is a perspective view of a fifth embodiment.
FIG. 10(B) is a sectional view of the fifth embodiment.
FIG. 10(C) is an elevational view of same.
Figure 10:
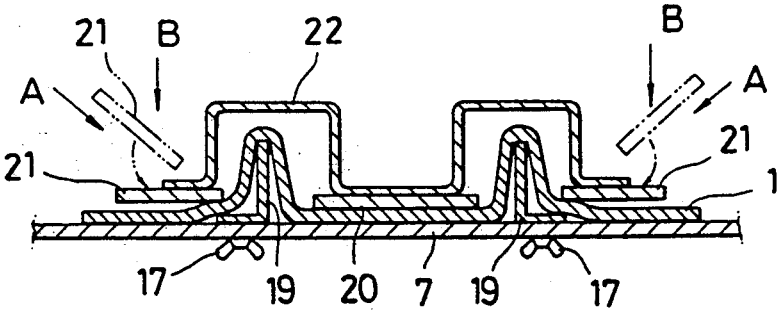
Figure 10:
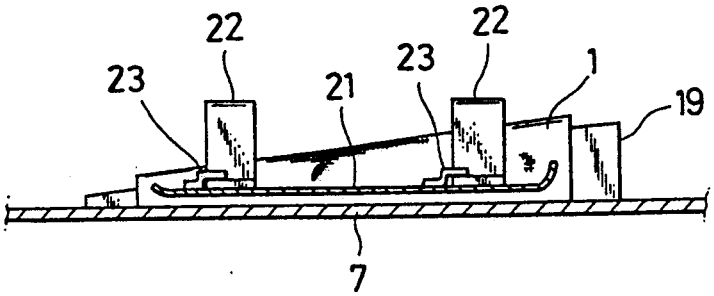

FIG. 7 shows a second embodiment of feeding device. In this embodiment, in place of the above-described hinged guide section (5), there is fixed a bent securing member (11) on the movable guide member. The securing member (11) is formed by bending same in the lateral direction thereof into the shape indicated in FIG. 7. In operation, the trim cover assembly (1) is laid over this securing member (11), and thereafter, the cap-like securing member (10) is pushed towards the free end of the securing member (11) in the direction laterally thereof so as to secure the relevant portion of trim cover assembly (1) firmly upon that free end of securing member (11). This brings about the same situation as in FIGS. 3(B) and 6. Then, trim cover assembly thus secured is fed to the sewing machine (M). The result comes likewise as explained above.

FIGS. 8(A) and 8(B) show a third embodiment of feeding device, in which, as an equivalent to the hinged guide member (5), there is provided an upstanding movable guide member (15) having the same sloped upper edge with that of upper hinged part of hinged guide member (5). As shown, in this particular embodiment, only one guide rail (8) is fixed on the work table (7), and in a spaced-apart and parallel relation with that guide rail (8), an L-shaped guide rail (8') is fixed on the same table (7). Slidably inserted between those two different guide rails (8) (8'), is the foregoing upstanding movable guide member (15), such that the movable guide member (5) may be moved in the arrow direction as in FIG. 8(B), upon the table (7). In operation, as can be seen from FIG. 8(A), the trim cover assembly (1) is laid upon the movable guide (15), and then weight plates (16) are placed on the opposite sides of the trim cover assembly (1). Thus, the relevant portion of cover member (1) is stretched sufficiently along the upper sloped edge of guide member (15). Thereafter, both trim cover assembly and guide member (15) are fed to the sewing machine (M).

FIGS. 9(A) to 9(C) show a fourth embodiment of feeding device. In contrast to the above first to third embodiments, no such movable guide member is provided in this fourth embodiment. Namely, according to the present embodiment, there is fixed a stationary guide member (14) upon the table (7), which is of a generally third-quarter-circle like cross-section (i.e. of a generally U-shaped cross-section), the guide member (14) thus having an elongated opening formed in its longitudinal direction. A plate-like rotatable guide member (12) is connected with this stationary guide member (14) in such a manner that the lower spherical part of rotatable guide (12) is movably received or resiliently grasped in the foregoing opening of stationary guide (14). The rotatable guide member (12) is formed in the same shape with that of the hinged guide member (5) of the first embodiment above, thus having a same sloped upper edge. In operation, the rotatable guide member (12) is located in an upright state upon the stationary guide member (14), and then the trim cover assembly (1) is laid over such vertically erected guide member (12). On the top of thus-placed trim cover assembly, a cap-like securing member (10') is fitted, which can be observed from FIG. 9(A). Next, together with the rotatable guide member (12), the trim cover assembly (1) is turned outwardly, likewise as in the first embodiment, down to the horizontal plane, generally, upon the table (17). That is, the rotatable guide (12) is turned about the center (14) at 90 degrees. Then, as understandable in FIG. 9(B), the securing member (10') is removed from the trim cover assembly (1), and as seen in FIG. 3(C), the rotatable guide member (12) is removed from the stationary guide one (14), at which step, an adhesive tape (13) is applied to the juxtaposed part (1*d*) of trim cover assembly (1) as illustrated so as to provisionally secure the same with respect to the table (17). The cover member (1) itself, under this state, is fed to the sewing machine (M).

FIGS. 10(A) to 10(C) show a fifth embodiment of feeding device in the present invention, according to which, like the above fourth embodiment, the trim cover assembly(1) per se is allowed to be fed to the sewing machine. Specifically, as different from all of the foregoing embodiments, there are a pair of stationary guide members (19)(19) fixed on the table (7) by means of wing nuts (17). These guides members (19) are similar in function to the hinged guide member (5) of the first embodiment, each of them thus having the same sloped upper edge with that of the latter one (5), as can be seen from FIG. 10(C). By adjusting the wing nuts (17), the spacing between the two guide members (19)(19) may be varied to a desired width. Each of guide members (19) is of L-shaped configuration in section, like the one (8') of the third embodiment above, and erected from the table (7). Of course, as discussed previously, the stationary guide members (19) are each disposed at a position corresponding to the respective areas of trim cover assembly (1) which are defined between the imaginary stitch lines (41', 42'). In operation, the trim cover assembly (1) is laid upon those two stationary guide members (19), after which, firstly, a central weight plate (20) is placed on the central area of trim cover assembly (1) which are defined between the two guides (19)(19), thereby giving a slight pressure thereupon, and secondly, a pair of separate lateral weight plates (21)(21) are respectively placed on both lateral areas of trim cover assembly (1) as best shown in FIG. 10(B). In this way, the trim cover assembly (1) is settled on the table (7) such as to lie closely along the respective sloped upper edges of guide members (19). Thereafter, as viewed from FIG. 10(a), a first securing member (22), which has a pair of spaced-apart inverted-U-shaped portions (22*a*)(22*a*), is placed upon the left-side region of both central and lateral weight plates (20)(21), and also a second securing member (22') of the identical shape to the first one (22) is placed upon the right-side region of those two weight plates (20)(21). Each of the inverted-U-shaped portions (22*a*)(22*a*) is of a height allowing the folded portions of trim cover assembly (1) to pass therethrough. As shown, the securing members (22)(22') are provisionally secured by adhesive tapes (23) to the weight plates (20)(21). The securing members (22)(22') may be fixed to the side of sewing machine (M). With this arrangement, the trim cover assembly (1) is passed through between the table (7) and weight plates (20)(21), with the folded portions of trim cover assembly being slidingly guided along the respective two guide members (19)(19), so as to be fed towards the sewing machine (M).

Figure 11:
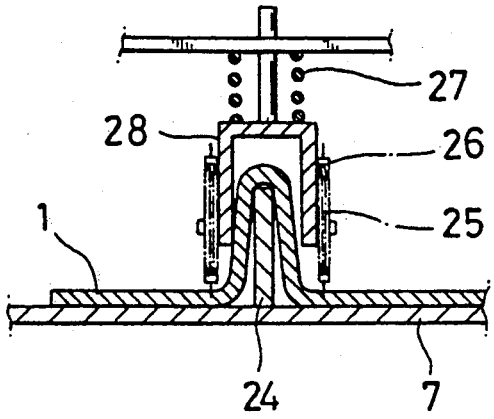
FIG. 11 is a sectional view of a sixth embodiment.
Figure 12:
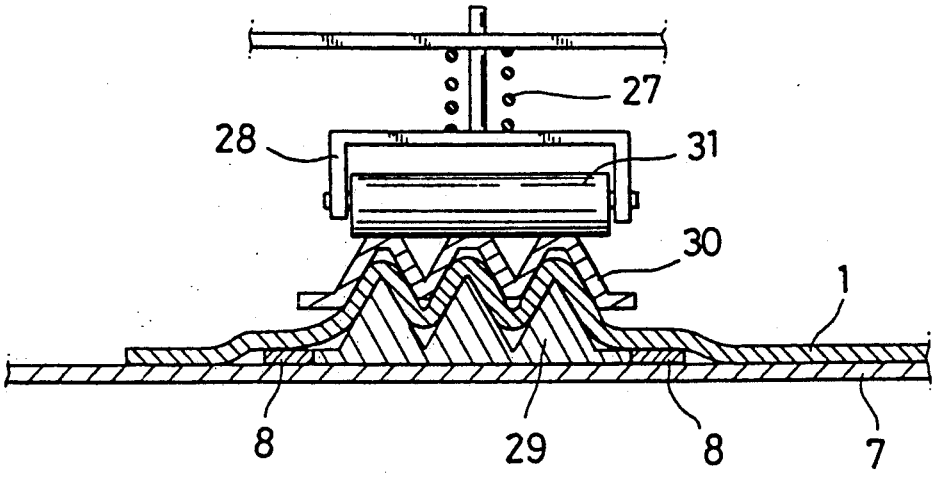
FIG. 12 is a sectional view of a seventh embodiment.

FIG. 11 shows a sixth embodiment of feeding device, which comprises a stationary guide member (24) fast upon the table, erecting therefrom, a cap-like securing member (28) which is biased in the downward direction by means of coil spring (27), and a pair of needle endless chains (26) provided at the respective lateral walls of the securing member (28). As shown, each of needle endless chains (26) is attached about a sprocket (25) which is fixed rotatably on the lateral wall of securing member (28). In this embodiment, the pinched and folded portion of trim cover assembly laid on the stationary guide member (24) is positively settled by the needle chain (26) with respect to the guide member (29). In this case, both upper and movable guide members (29)(30) are fed together with the trim cover assembly (1) towards the sewing machine (M).

The above method and devices may be applied to such a bracket as a moquette or other top surface members.

Figure 1:
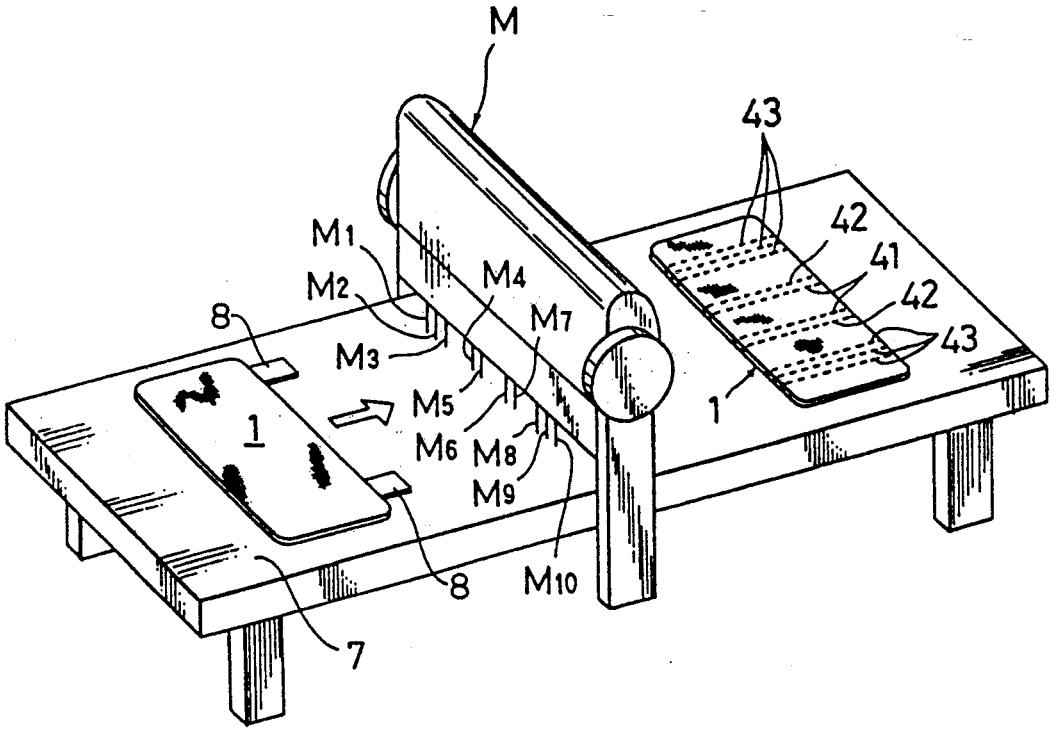
FIG. 1 (A) PRIOR ART
FIG. 1(A) is a perspective view of a multiple-needle sewing machine used in the present invention.
FIG. 1(B) is a partly enlarged section view of a trim cover assembly, showing the state of the trim cover assembly to be stitched.
Figure 1:
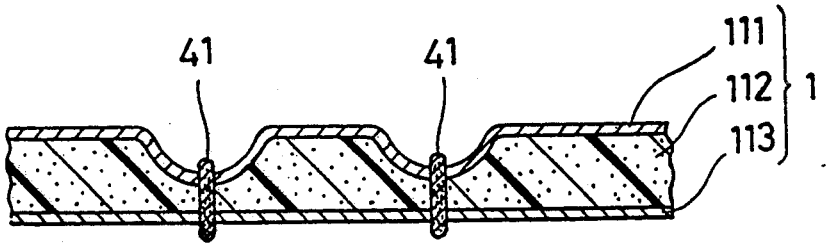
FIG. 1 (B) PRIOR ART

While the trim cover assembly (1) used is of three-layer lamination as shown in FIG. 1(B), the present invention may be applied to the case where a top surface layer is sewn to a lamination of wadding and wadding cover, or to the case where three separate layers are sewn together.

The guide members mentioned above are all rectilinear in their longitudinal directions, but it may be possible to form the guide members in a curved manner in order to make the stitching curved in the expanded trim cover assembly.

According to the present invention, it is therefore seen that a plurality of non-parallel or slant stitches can be formed on the expanded trim cover assembly by simply subjecting the trim cover assembly stitching by plural needles of ordinary conventional multiple-needle sewing machine. In addition, one unitary sheet of trim cover assembly can be obtained, whose slant stitches thus formed may suitably be transformed into parallel stitches, as applied to such seat cushion (SC) having a sloped protruded portion (H).

What is claimed is:

1. A method of feeding a unitary sheet of trim cover assembly to a multiple-needle sewing machine for creating plural stitches thereon, comprising the steps of pinching upwardly a part of said trim cover assembly such as to form a folded portion therein; causing said folded portion to be inclined at a certain inclination angle, thereby making its upper edge sloped at said inclination angle; retaining said folded portion upon a guide means; then feeding the thus-formed trim cover assembly with said sloped, folded portion defined therein towards said multiple-needle sewing machine; and, creating plural stitches on opposite sides of said folded portion of said trim cover assembly in a parallel relation with one another, whereby an expanded sheet of said trim cover assembly, after having undergone said stitching, contains some of said plural stitches which extend across said trim cover assembly in parallel with one another, whereas other of said plural stitches extend in a non-parallel manner relative to said some of said plural stitches.

2. The method as defined in claim 1, wherein said method further includes the steps of providing a seat having a protruded portion which is sloped at an inclination angle; causing said folded portion of said trim cover assembly to be inclined at an angle equal to said inclination angle of said protruded portion in said seat; then subjecting said trim cover assembly to stitching by said multiple-needle sewing machine; and thereafter covering said seat with thus formed trim cover assembly, whereby said stitches on said trim cover assembly extend in parallel with said protruded portion in said seat.

3. The method as defined in claim 1, wherein said method further includes the steps of forming said unitary sheet of trim cover assembly in such a fashion that, relative to its rectangular section, there is defined an inclined section which has an inclination angle substantially equal to said inclination angle of said folded portion of said trim cover assembly, so that, when pinching the thus-formed trim cover assembly at said inclined section to form a new folded portion therein that is inclined at an angle equal to said inclination angle, the trim cover assembly presents a uniform flat surface without any creases thereon.

4. The method as defined in claim 1, wherein said multiple-needle sewing machine has a table, wherein said guide means is provided on said table, and wherein said guide means has an inclined portion such that one end thereof is small in height and another end thereof is great in height.

5. The method as defined in claim 4, wherein said guide means comprises a hinged guide member which can be turned from its upright position and down to its horizontal position, said hinged guide member being slidable upon said table, and wherein, when said hinged guide member is set in said upright position, said trim cover assembly is laid thereon, then a cap-like securing member is fitted over both said hinged guide member and trim cover assembly, after which, said hinged guide member is turned down to said horizontal position and said trim cover assembly is fed to said multiple-needle sewing machine together with said hinged guide member.

6. The method as defined in claim 4, wherein said guide means comprises a guide member which extends in a direction traversing said table, said guide member being slidable on said table, and wherein said trim cover assembly is laid on said guide member, then a cap-like securing member is fitted over both said guide member and trim cover assembly, after which, said trim cover assembly is fed to said multiple-needle sewing machine together with said guide member.

7. The method as defined in claim 4, wherein said means comprises an upstanding guide member slidable on said table, and wherein, said trim cover assembly is laid on said upstanding guide member, then a pair of weight plates are placed on said trim cover assembly such as to be disposed on opposite sides of said upstanding guide member, thereby giving a slight pressure thereon, and thereafter, said trim cover assembly is fed to said multiple-needle sewing machine together with said guide member.

8. The method as defined in claim 4, wherein said guide means comprises a plate-like guide member and a resilient receiving member, wherein said resilient receiving member is fixed on said table, and said plate-like guide member is detachably received in said resilient receiving member such as to be rotatable about said receiving member between an upright position and a horizontal position, and wherein when said plate-like guide member is set in said upright position, said trim cover assembly is laid thereon, then a cap-like securing member is fitted over both said guide member and trim cover assembly so as to settle said trim cover assembly along said guide member, after which, said guide member is removed from said resilient receiving member, then only thus-folded portion of trim cover assembly is provisionally retained by a suitable means, and said trim cover assembly is fed to said multiple-needle sewing machine.

9. The method as defined in claim 4, wherein said guide means comprises an upstanding guide member which is fixed on said table by means of a wing nut, a central weight plate, a pair of weight plates, and a securing member for securing said pair of weight plates, and wherein said trim cover assembly is laid on said upstanding guide member, then said pair of weight plates are placed on said trim cover assembly such as to be disposed on opposite sides of said guide member, thereby applying a slight pressure thereon, then said weight plates are secured by means of said securing member, whereupon there is defined said folded portion in said trim cover assembly, after which the trim cover assembly is passed through between said weight plates and guide member and fed to said multiple-needle sewing machine.

10. The method as defined in claim 4, wherein said guide means comprises an upstanding guide member fixed on said table, a sprocket and a needle chain means attached over said sprocket, and wherein said trim cover assembly is laid on said upstanding guide member, then said needle chain means is disposed on opposite sides of said upstanding guide member such as to engage said trim cover assembly, and by operation of said needle chain means, said trim cover assembly is fed to said multiple sewing machine.

11. The method as defined in claim 4, wherein said guide means comprises a corrugated guide member which is movable on said table, having a plurality of corrugations disposed in a direction traversing said table, an upper corrugated guide member having a plurality of corrugations which fit engageably with said corrugations of said guide member, and a roller which is so biased as to give a light pressure upon an upper part of said upper corrugated guide member, and wherein said trim cover assembly is laid on said corrugated guide member and is then pressed thereagainst by said upper corrugated guide member, after which, by operation of said roller, said trim cover assembly is fed together with said both guide members towards said multiple-needle sewing machine.

* * * * *